US011085135B2

(12) United States Patent
Kino et al.

(10) Patent No.: US 11,085,135 B2
(45) Date of Patent: Aug. 10, 2021

(54) KNITTING METHOD OF BAG-SHAPED KNITTED FABRIC, AND BAG-SHAPED KNITTED FABRIC

(71) Applicant: SHIMA SEIKI MFG., LTD., Wakayama (JP)

(72) Inventors: Takashi Kino, Wakayama (JP); Miku Kobayashi, Wakayama (JP)

(73) Assignee: Shima Seiki Mfg., Ltd., Wakayama (JP)

( * ) Notice: Subject to any disclaimer, the term of this patent is extended or adjusted under 35 U.S.C. 154(b) by 0 days.

(21) Appl. No.: 16/925,876

(22) Filed: Jul. 10, 2020

(65) Prior Publication Data

US 2021/0025089 A1 Jan. 28, 2021

(30) Foreign Application Priority Data

Jul. 22, 2019 (JP) ..... JP2019-134849

(51) Int. Cl.
*D04B 1/10* (2006.01)
*D04B 1/22* (2006.01)

(52) U.S. Cl.
CPC ..... *D04B 1/108* (2013.01); *D04B 1/22* (2013.01); *D10B 2403/0332* (2013.01); *D10B 2501/043* (2013.01)

(58) Field of Classification Search
CPC ..... D04B 1/22; D04B 1/108; D04B 1/26; D04B 7/04; D04B 7/30; D04B 7/32; A43B 1/04
See application file for complete search history.

(56) References Cited

U.S. PATENT DOCUMENTS 9,551,096 B2 * 1/2017 Nishino ..... D04B 1/26
9,719,198 B2 * 8/2017 Ikenaka ..... D04B 1/22
10,683,594 B2 * 6/2020 Li ..... D04B 1/108
(Continued)

FOREIGN PATENT DOCUMENTS

EP 2149629 A1 2/2010
WO 2008143172 A1 11/2008

*Primary Examiner* — Danny Worrell
(74) *Attorney, Agent, or Firm* — Rothwell, Figg, Ernst & Manbeck, P.C.

(57) ABSTRACT

Provided is a knitting method of a bag-shaped knitted fabric that can make a setup portion inconspicuous in knitting a bag-shaped knitted fabric from a closed end region in which a tube diameter changes. A knitting method of a bag-shaped knitted fabric for knitting a bag-shaped knitted fabric including a closed end region and a remaining part other than the closed end region, including: a step A of forming a setup portion in which a knitting yarn is alternately held on a front needle bed and a back needle bed; a step B of forming the closed end region by repeating, sequentially from one end side in a knitting width direction of the setup portion toward another end side thereof, C-shaped knitting in which the one end side serves as a turn back side; and a step C of knitting the remaining part of the bag-shaped knitted fabric, following a termination in a wale direction of the closed end region. In the step B, when repeating the C-shaped knitting, a portion on the front needle bed side of the setup portion and a portion on the back needle bed side of the setup portion are connected directly or indirectly, and a knitting width of the C-shaped knitting is changed.

4 Claims, 5 Drawing Sheets

(56) References Cited

U.S. PATENT DOCUMENTS

| | | | | |
|---|---|---|---|---|
| 2007/0051137 | A1* | 3/2007 | Okuno | D04B 1/18 66/64 |
| 2016/0017524 | A1* | 1/2016 | Nishino | A43B 1/04 28/153 |
| 2016/0143394 | A1* | 5/2016 | Ikenaka | A43B 23/0205 36/45 |
| 2017/0342612 | A1* | 11/2017 | Kawakami | D04B 7/30 |
| 2018/0343956 | A1* | 12/2018 | Li | D04B 1/108 |
| 2021/0025089 | A1* | 1/2021 | Kino | D04B 1/24 |

* cited by examiner

KNITTING METHOD OF BAG-SHAPED KNITTED FABRIC, AND BAG-SHAPED KNITTED FABRIC

CROSS REFERENCE TO RELATED APPLICATION(S)

This application claims priority to Japanese Application No. 2019-134849, filed Jul. 22, 2019. The entirety of the disclosure of the above-referenced application is incorporated herein by reference.

TECHNICAL FIELD

The present invention relates to a knitting method of a bag-shaped knitted fabric, and a bag-shaped knitted fabric.

BACKGROUND ART

A knitting method of a bag-shaped knitted fabric is known for knitting a bag-shaped knitted fabric constituted by a knitted fabric formed in a tubular shape with one end thereof closed. The bag-shaped knitted fabric includes a closed end region formed in a bag shape including a closed portion, and a tubular remaining part other than the closed end region. The closed end region refers to a region extending from a portion X to a portion Y. The portion X is a portion that constitutes the bottom of a bag-shaped knitted fabric and that includes a setup portion serving as the starting point of knitting of the bag-shaped knitted fabric. The portion Y is a tubular portion which can be knitted by circling knitting.) For example, the knitting method of a three-dimensional knitted article disclosed in Patent Literature 1 can be used to three-dimensionally knit a bag-shaped knitted fabric including a closed end region. In this knitting method, first, a knitted fabric part of a bottom face having four edges is knitted, and a tubular knitted fabric part that is continuous with the four edges in the wale direction is knitted. As a result, a three-dimensional, bag-shaped knitted fabric is knitted. In this bag-shaped knitted fabric, a front end-side portion of the bag-shaped knitted fabric that includes the knitted fabric part of the bottom face and a portion of the tubular knitted fabric part on the knitted fabric part side of the bottom face constitute the closed end region.

CITATION LIST

Patent Literature

Patent Literature 1: WO 2008/143172A

SUMMARY OF INVENTION

Technical Problem

A bag-shaped knitted fabric whose tube diameter has been significantly changed while knitting a closed end region may be knitted in some cases. Examples of such a bag-shaped knitted fabric include a shoe. In the shoe, the portion corresponding to the toe of a foot constitutes a closed end region. When a shoe is knitted with the knitting method described in Patent Literature 1, the boundary between the knitted fabric part of the bottom face and the tubular knitted fabric part in Patent Literature 1 is clearly defined, and the orientations of stitches of the two knitted fabric parts are different. Accordingly, the knitted fabric part of the bottom face may become conspicuous.

When the tube diameter in the closed end region of the shoe is changed by the knitting method of Patent Literature 1, widening or narrowing is performed on both the portion on the instep side and the portion on the sole side of the tubular knitted fabric part. The orientation of stitches changes at a portion of the instep-side portion where widening or narrowing has been performed, and that portion appears to be an unintended pattern.

An object of the present invention is to provide a knitting method of a bag-shaped knitted fabric that can make a setup portion inconspicuous in knitting a bag-shaped knitted fabric from a closed end region in which the tube diameter changes. Another object of the present invention is to provide a bag-shaped knitted fabric in which a setup portion provided in a closed end region in which a tube diameter changes is inconspicuous.

Solution to Problem (1) A knitting method of a bag-shaped knitted fabric according to the present invention is a knitting method of a bag-shaped knitted fabric for knitting a bag-shaped knitted fabric including a closed end region and a remaining part other than the closed end region, using a flat knitting machine including a front needle bed and a back needle bed, including:

a step A of forming a setup portion in which a knitting yarn is alternately held on the front needle bed and the back needle bed;

a step B of forming the closed end region by repeating, sequentially from one end side in a knitting width direction of the setup portion toward another end side thereof, C-shaped knitting in which the one end side serves as a turn back side such that the setup portion extends in a tube axis direction of the bag-shaped knitted fabric; and a step C of knitting the remaining part of the bag-shaped knitted fabric, following a termination in a wale direction of the closed end region, wherein, in the step B, when repeating the C-shaped knitting, a portion on the front needle bed side of the setup portion and a portion on the back needle bed side of the setup portion are connected directly or indirectly, and a knitting width of the C-shaped knitting is changed.

(2) An exemplary embodiment of the knitting method of a bag-shaped knitted fabric according to the present invention includes, before the step B, a step D of forming, by flechage knitting, a first knitted fabric part following a stitch row of the setup portion that is held on the front needle bed, and forming, by flechage knitting, a second knitted fabric part following a stitch row of the setup portion that is held on the back needle bed, wherein, in the step B, the first knitted fabric part and the second knitted fabric part are connected by the C-shaped knitting.

(3) As an exemplary embodiment of the knitting method of a bag-shaped knitted fabric described in (2) above, in the step D, the first knitted fabric part is formed by repeating: flechage knitting; moving a stitch row formed by the flechage knitting to the other end side; and forming a first widening stitch on an empty needle formed by the moving, and the second knitted fabric part is formed by repeating: flechage knitting; moving a stitch row formed by the flechage knitting to the other end side; and forming a second widening stitch on an empty needle formed by the moving, and, in the step B, a knitting range of the C-shaped knitting that is performed first includes all the first widening stitches included in the first knitted fabric part and all the second widening stitches included in the second knitted fabric part.

(4) A bag-shaped knitted fabric according to the present invention includes:

a closed end region; and a remaining part other than the closed end region, wherein the closed end region includes:

a setup portion provided in one region in a circumferential direction of the closed end region and extending in a tube axis direction of the bag-shaped knitted fabric; and a C-shaped knitting part for sandwiching the setup portion, the C-shaped knitting part is sequentially formed from a front end side of the closed end region, the remaining part is formed continuously with a termination in a wale direction of the C-shaped knitting part, and a knitting width of the C-shaped knitting part changes in the wale direction of the C-shaped knitting part.

Effects of the Invention

According to the knitting method of a bag-shaped knitted fabric described in (1) above, in the closed end region of the bag-shaped knitted fabric, the setup portion of the bag-shaped knitted fabric is formed so as to extend in the tube axis direction of the bag-shaped knitted fabric. That is, the setup portion can be disposed in one region, in the circumferential direction, of the bag-shaped knitted fabric, rather than at the front end of the bag-shaped knitted fabric. This makes it possible to easily conceal the setup portion of the bag-shaped knitted fabric. For example, in the case of knitting a shoe as the bag-shaped knitted fabric, it is possible to make the setup portion completely invisible from the outside by placing the setup portion on the sole side of the shoe.

According to the knitting method of a bag-shaped knitted fabric described in (1) above, widening or narrowing for changing the tube diameter in the closed end region can be focused on the side of the closed end region on which the setup portion is disposed. Accordingly, a portion where widening or narrowing has been performed can be disposed at an inconspicuous position of the bag-shaped knitted fabric, together with the setup portion.

According to the knitting method of a bag-shaped knitted fabric described in (2) above, before performing the C-shaped knitting, by forming a portion of the closed end region by knitting the first knitted fabric part and the second knitted fabric part according to an increase or a decrease in the tube diameter in the closed end region, it is possible to reduce the number of times that widening or narrowing is performed in order to change the knitting width when repeating the C-shaped knitting. Accordingly, it is possible to inhibit formation of an unintended pattern caused by widening or narrowing.

According to the knitting method of a bag-shaped knitted fabric described in (3) above, the closed end region is prevented from sharpening, and the closed end region can be easily formed in a wide shape. The reason for this is that, when the first knitted fabric part and the second knitted fabric part are removed from the needle bed, an edge constituted by the first widening stitches included in the first knitted fabric part and an edge constituted by the second widening stitches included in the second knitted fabric part are connected in a nearly flat state.

The bag-shaped knitted fabric described in (4) above has an excellent appearance. The reason for this is that, since the setup portion of the bag-shaped knitted fabric is formed so as to extend in the tube axis direction of the closed end region, the setup portion can be disposed at an inconspicuous position of the bag-shaped knitted fabric.

DESCRIPTION OF EMBODIMENTS

Embodiment 1

In Embodiment 1, an example in which a shoe is knitted using a knitting method of a bag-shaped knitted fabric according to the present invention will be described. The flat knitting machine used for knitting the shoe may be a two-bed flat knitting machine including one front needle bed and one back needle bed, or may be a four-bed flat knitting machine including two front needle beds and two back needle beds.

Figure 1:
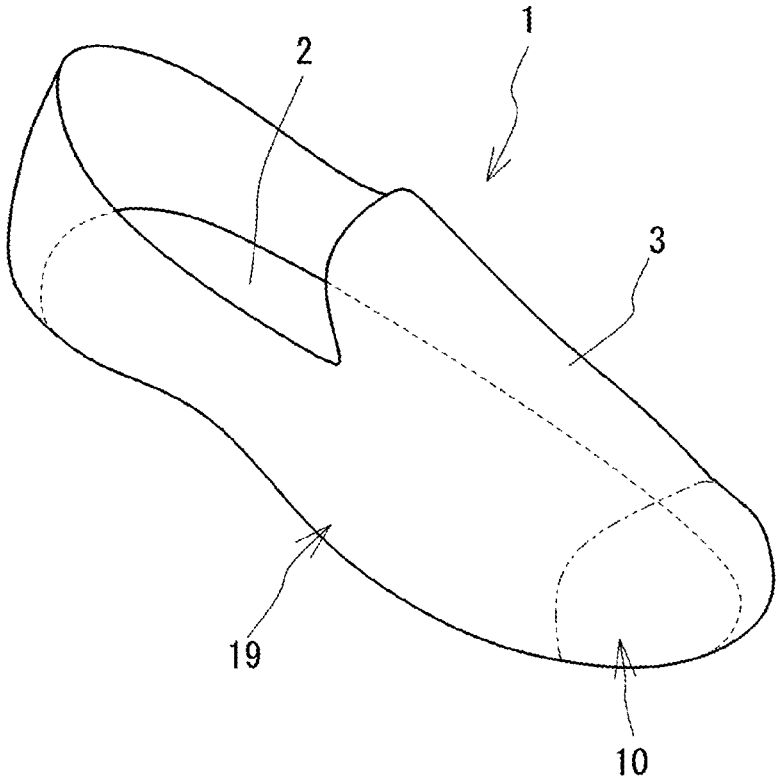
FIG. 1 is a diagram schematically showing a configuration of a shoe as an example of a bag-shaped knitted fabric described in Embodiment 1.

The shoe 1 (bag-shaped knitted fabric) shown in FIG. 1 includes a sole cover 2 for covering the sole of a foot, and an instep cover 3 for covering the instep side of the foot. A portion (closed end region 10) of the shoe 1 that corresponds to the toe has a rounded shape. A foot-insertion opening portion, a heel cover, and the like are formed in the remaining part 19 other than the closed end region 10. One of the characteristics of the shoe 1 is that a setup portion 10*s* (FIG. 2) of the shoe 1 is formed on the sole cover 2 side in the closed end region 10.

Figure 2:
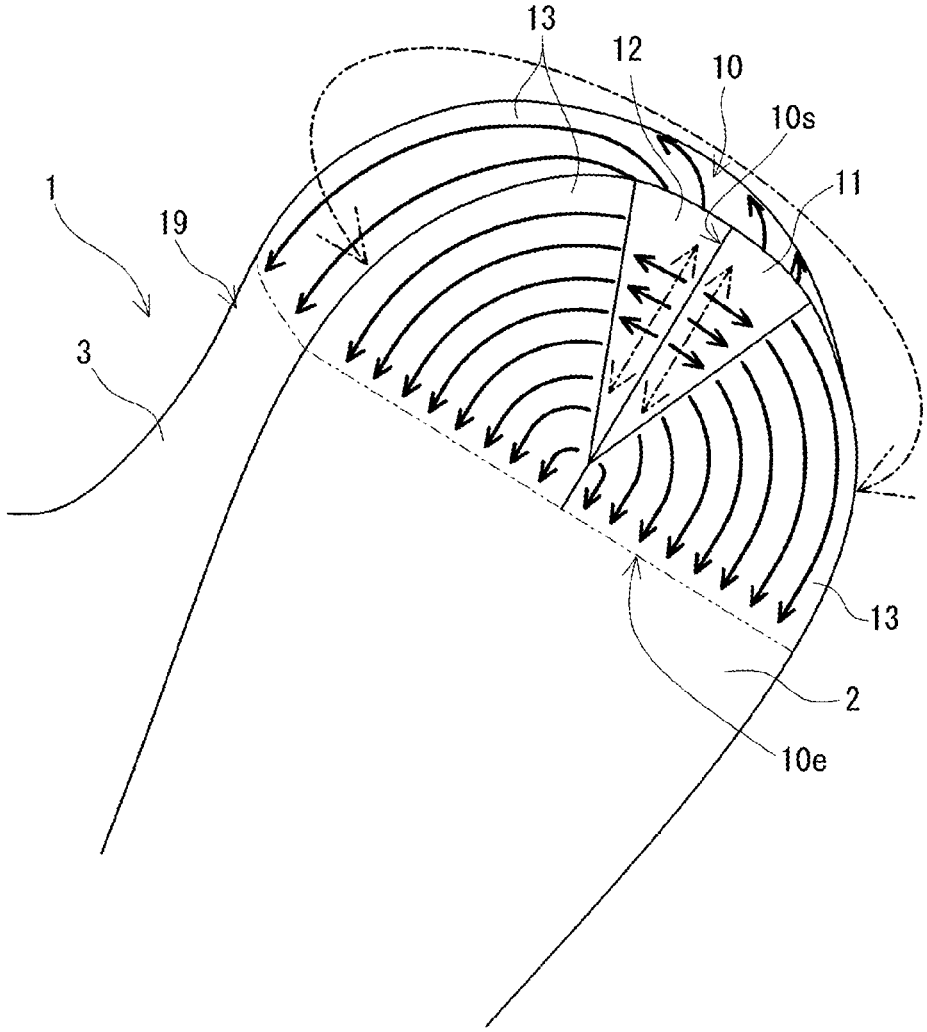
FIG. 2 is a diagram schematically showing a configuration of a portion on the toe side of the shoe shown in FIG. 1, as viewed from the sole side thereof.

FIG. 2 is a partially enlarged view of the vicinity of the closed end region 10 of the shoe 1 shown in FIG. 1, as viewed from the sole cover 2 side. In FIG. 2, a course direction is indicated by the dashed dotted arrow, and the orientation of stitches is indicated by the thick arrows. The course direction is equal to the length direction of the needle beds when knitting is performed using a flat knitting machine. A direction orthogonal to the course direction is the wale direction. The wale direction may be considered as being equal to the orientation of stitches.

As shown in FIG. 2, the closed end region 10 of the present example is composed of a setup portion 10*s*, a first knitted fabric part 11, a second knitted fabric part 12, and a C-shaped knitting part 13. The setup portion 10*s* of the shoe 1 is provided in one region, in the circumferential direction, of the closed end region 10, and extends in the tube axis direction of the shoe 1 (the same as the tube axis direction of the closed end region 10). In the present example, a first knitted fabric part 11 and a second knitted fabric part 12 that sandwich the setup portion 10*s* therebetween are formed. The first knitted fabric part 11 and the second knitted fabric part 12 are formed so as to branch off from the setup portion 10*s*. Accordingly, the course direction of the two knitted fabric parts 11 and 12 is the same as the extension direction of the setup portion 10*s*, but the orientation of stitches of the first knitted fabric part 11 and the orientation of stitches of the second knitted fabric part 12 face away from each other. Since the setup portion 10*s*, the first knitted fabric part 11, and the second knitted fabric part 12 are formed on the sole cover 2, they are not visible from the instep side. Usually, a resin outer sole is attached to the sole cover 2, and, therefore, the setup portion 10*s*, for example, becomes completely invisible from the outside.

The first knitted fabric part 11 and the second knitted fabric part 12 are connected by the C-shaped knitting part 13. The C-shaped knitting part 13 is formed by C-shaped knitting in which a stitch at an end in the wale direction of the first knitted fabric part 11 and a stitch at an end the wale direction of the second knitted fabric part 12 are joined. That is, the C-shaped knitting part 13 is formed so as to sandwich the setup portion 10*s* via the first knitted fabric part 11 and the second knitted fabric part 12. The direction in which the C-shaped knitting part 13 is formed is a direction extending from one end side (the toe side of the shoe 1) of the setup portion 10*s* toward the other end side (the heel side of the shoe 1) of the setup portion 10*s*. Accordingly, the course direction of the C-shaped knitting part 13 is the same as the circumferential direction of the closed end region 10, and the orientation of stitches of the C-shaped knitting part 13 faces the heel side of the shoe 1. Since the orientation of stitches of the C-shaped knitting part 13 is aligned, with no misalignment in the orientation of stitches due to increases and decreases of stitches, the shoe 1 has a good appearance.

The remaining part 19 of the shoe 1 is knitted following the termination in the wale direction of the C-shaped knitting part 13, that is, a termination 10*e* of the closed end region 10. The remaining part 19 is formed by combining tubular knitting, C-shaped knitting, flechage knitting, and the like as appropriate.

The shoe 1 shown in FIGS. 1 and 2 is knitted with the knitting method of a bag-shaped knitted fabric according to the present invention. An example of the knitting method of a bag-shaped knitted fabric of the present invention will be described with reference to the knitting process diagrams shown in FIGS. 3 and 4 and the images shown in FIGS. 5A and 5B. The flat knitting machine used in the present example is a four-bed flat knitting machine in which a front needle bed and a back needle bed that oppose each other are arranged in two (upper and lower) stages. In the knitting process diagrams, only the front needle bed (hereinafter referred to as the "FB") and the back needle bed (hereinafter referred to as the "BB") on the lower side of the four-bed flat knitting machine are shown. The front needle bed and the back needle bed on the upper side, which are not shown, are used for moving stitches in the present example.

Figure 3:
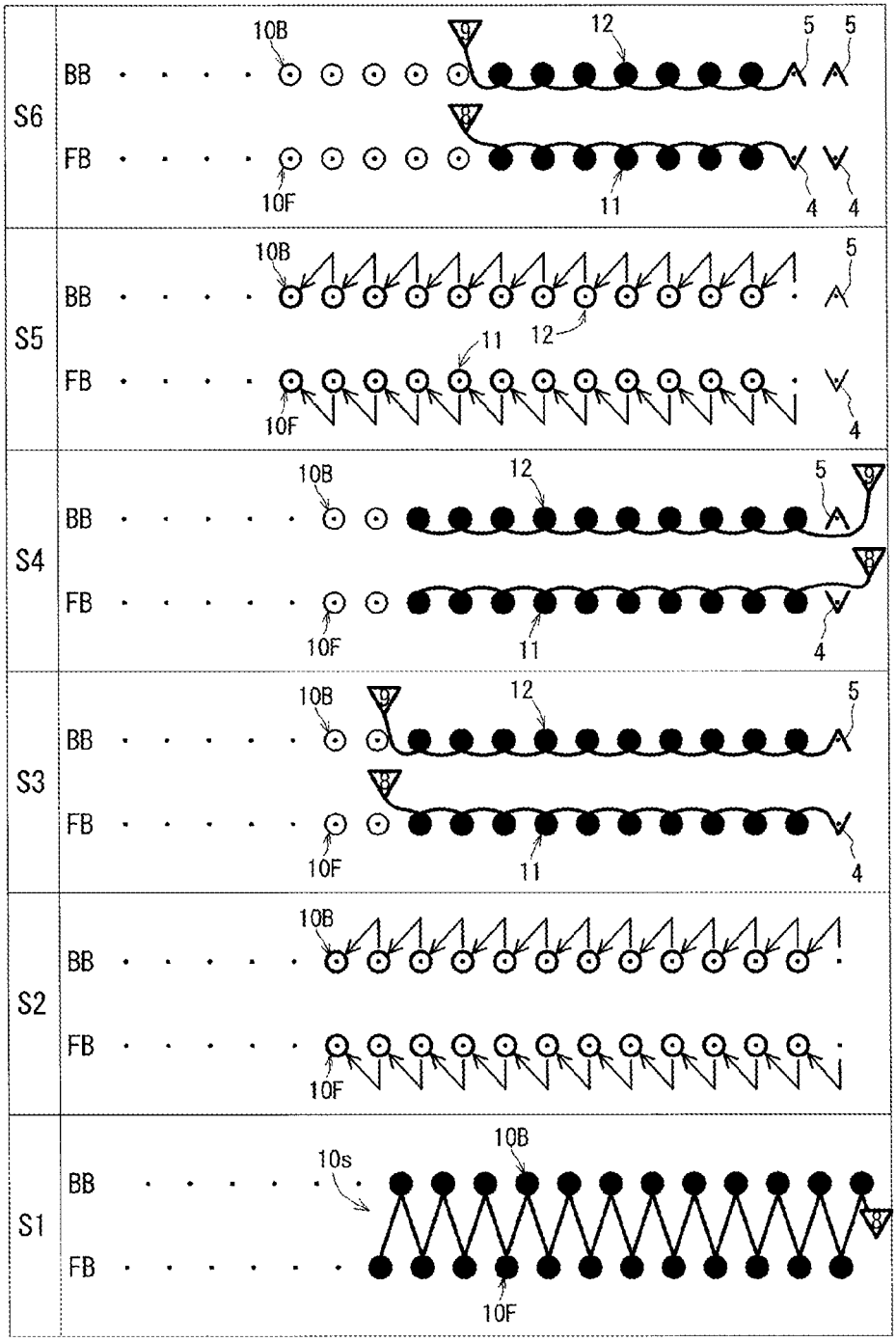
FIG. 3 is a knitting process diagram of a closed end region included in the shoe described in Embodiment 1.
Figure 4:
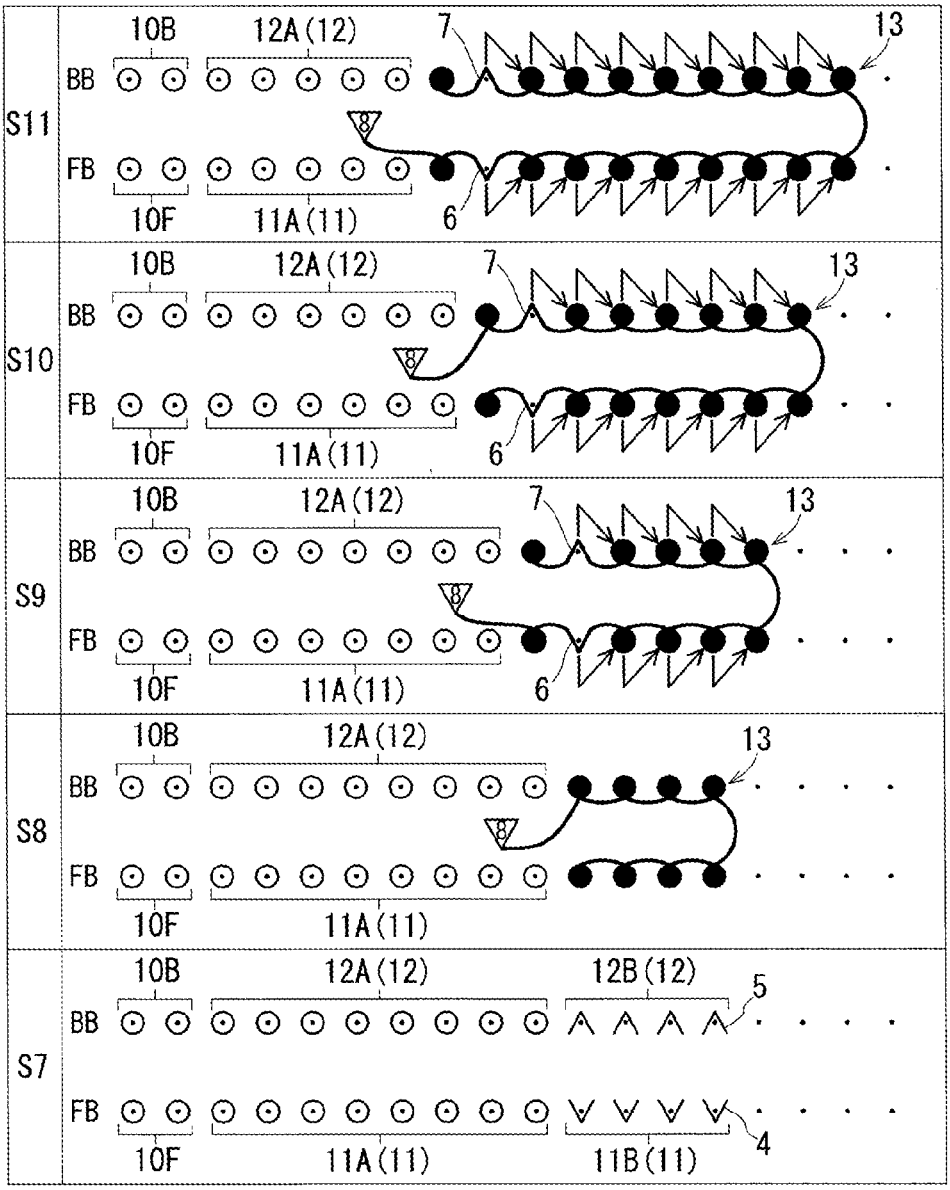
FIG. 4 is a knitting process diagram following FIG. 3.

In FIGS. 3 and 4, the letter "S" followed by a numeral indicates a knitting process number, and the black dots indicate the needles of the FB and the BB. The mark "V" indicates a pick up stitch (a kind of stitches), the black circles indicate stitches that are newly knitted in the knitting processes, the inverted triangular marks indicate yarn feeders 8 and 9, and the straight arrows indicate transferring. The knitting operations performed in the knitting processes are indicated by the thick lines.

In S1 of FIG. 3, a yarn feeder 8 is moved to the right side on the plane of paper, and a setup portion 10*s* that is alternately held on the FB and the BB is formed (step A). The FB and the BB are displaced from each other by 0.5 pitches. A known formation method may be used for forming the setup portion 10*s*. In the present example, the setup portion 10*s* is formed by forming stitches alternately on the FB and the BB. However, it is possible to form a plurality of stitches on the FB or the BB, and thereafter allocate the stitches between the FB and the BB.

In S2 to S6, a first knitted fabric part 11 following at least a portion of a stitch row 10F of the setup portion 10*s* that is held on the FB is knitted, and a second knitted fabric part 12 following at least a portion of a stitch row 10B of the setup portion 10*s* that is held on the BB is knitted (step D). More specifically, the first knitted fabric part 11 is formed by repeating, on the FB, flechage knitting in which the knitting width is gradually narrowed. Similarly, the second knitted fabric part 12 is formed by repeating, on the BB, flechage knitting in which the knitting width is gradually narrowed. A specific knitting procedure for the two knitted fabric parts 11 and 12 will be described below. In the following description, the right side on the plane of paper is assumed to be one end side of the setup portion 10*s*, and the left side on the plane of paper is assumed to be the other end side of the setup portion 10*s*.

In S2, the needles of the FB and the needles of the BB oppose each other, and all the stitches (stitch row 10F) held on the FB are moved by one needle to the other end side, and all the stitches (stitch row 10B) held on the BB are moved by one needle to the other end side.

In S3, the yarn feeder 8 is moved leftward, and a pick up stitch (first widening stitch 4) is formed on an empty needle formed by the movement of the stitch row 10F. Thereafter, one course of the first knitted fabric part 11 is knitted following a portion other than the two stitches on the other end side of the stitch row 10F in the wale direction. In addition, another yarn feeder 9 is moved leftward, and a pick up stitch (second widening stitch 5) is formed on an empty needle formed by the movement of the stitch row 10B. Thereafter, one course of the second knitted fabric part 12 is knitted following a portion other than the two stitches on the other end side of the stitch row 10B in the wale direction.

In S4, the yarn feeder 8 is moved rightward, and one course of the first knitted fabric part 11 is knitted following, in the wale direction, the stitch row of the first knitted fabric part 11 formed in S3. In addition, the yarn feeder 9 is moved rightward, and one course of the second knitted fabric part 12 is knitted following, in the wale direction, the stitch row of the second knitted fabric part 12 formed in S3. By the flechage knitting performed in S3 and S4, a first knitted fabric part 11 and a second knitted fabric part 12 each having a length in the knitting width direction shorter than that of the setup portion 10*s* are knitted.

In and after S5, the knitting similar to S2 to S4 is repeated. In FIG. 3, only S5 and S6 corresponding to S2 and S3 are illustrated, and the knitting corresponding to S4 has been omitted. In S5, all the stitches other than the widening stitches 4 and 5 are moved by one needle to the other end side. In S6, the yarn feeder 8 (9) is moved leftward, and a first widening stitch 4 (second widening stitch 5) is formed on an empty needle formed by the movement of the stitches in S5. Thereafter, one course of the first knitted fabric part 11 (second knitted fabric part 12) is knitted. The knitting width of the first knitted fabric part 11 (second knitted fabric part 12) in S6 is shorter than the knitting width of the first knitted fabric part 11 (second knitted fabric part 12) in S3.

Figure 5A:
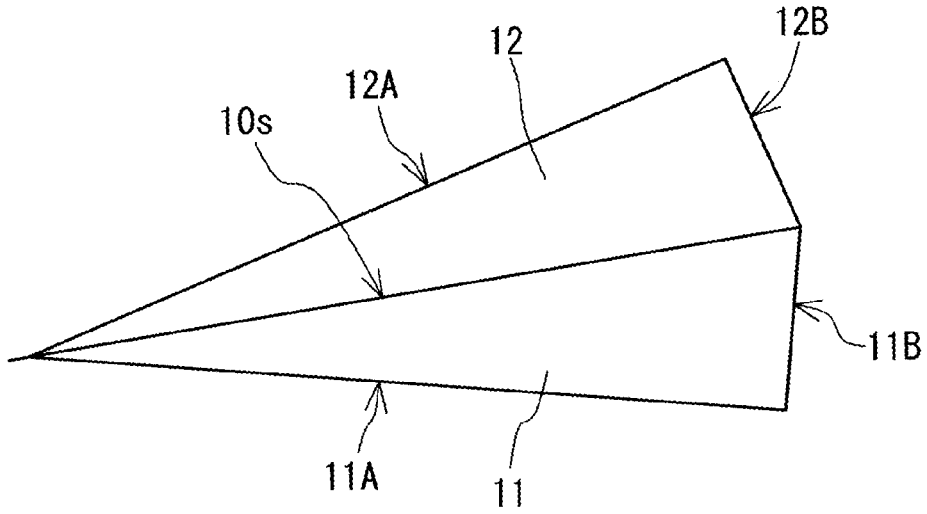
FIGS. 5A and 5B are images showing formed states of the shoe at relevant points in the knitting processes.

S7 in FIG. 4 shows a state in which the knitting for the first knitted fabric part 11 and the second knitted fabric part 12 is completed. FIG. 5A shows a formed state of the shoe 1 in S7. As shown in FIG. 5A, the first knitted fabric part 11 and the second knitted fabric part 12 are formed so as to sandwich the setup portion 10*s* therebetween. The first knitted fabric part 11 and the second knitted fabric part 12 are each formed in a substantially triangular shape. The stitches held on the FB in S7 constitute a long edge 11A of the first knitted fabric part 11, and the first widening stitches 4 held on the FB constitute a short edge 11B of the first knitted fabric part 11. On the other hand, the stitches held on the BB in S7 constitute a long edge 12A of the second knitted fabric part 12, and the second widening stitches 5 held on the BB constitute a short edge 12B of the second knitted fabric part 12. As shown in FIG. 5A, the short edges 11B and 12B constituted by the widening stitches 4 and 5 are in a nearly flat state when removed from the FB and the BB.

In and after S8, C-shaped knitting in which one end side of the setup portion 10*s* serves as the turn back side is repeated, and a portion on the FB side of the setup portion 10*s* and a portion on the BB side of the setup portion 10*s* are connected sequentially from one end side in the knitting width direction of the setup portion 10*s* toward the other end side thereof (step B). In the present example, the first knitted fabric part 11 and the second knitted fabric part 12 are knitted following the setup portion 10*s*, and, therefore, the portion on the FB side of the setup portion 10*s* and the portion on the BB side of the setup portion 10*s* are indirectly connected via the first knitted fabric part 11 and the second knitted fabric part 12. A specific knitting procedure will be described below.

In S8, the yarn feeder 8 is reciprocally moved to perform C-shaped knitting. The knitting range of the C-shaped knitting that is performed first includes all the first widening stitches 4 included in the first knitted fabric part 11, and all the second widening stitches 5 included in the second knitted fabric part 12. By this C-shaped knitting, one course of the C-shaped knitting part 13 connected to the first widening stitch 4 and the second widening stitch 5 in the wale direction is knitted.

In S9, the stitches of the C-shaped knitting part 13 that have been formed in S8 are moved to the one end side (right side). Thereafter, using the yarn feeder 8, C-shaped knitting is performed to form one course of the C-shaped knitting part 13. At this time, the start end of the C-shaped knitting is set at the position of a stitch at an end of the long edge 12A of the second knitted fabric part 12, and the termination of the C-shaped knitting is set at the position of a stitch at an end of the long edge 11A of the first knitted fabric part 11. Additionally, a third widening stitch 6 and a fourth widening stitch 7 are respectively formed on empty needles formed by the movement of the C-shaped knitting part 13.

Figure 5B:
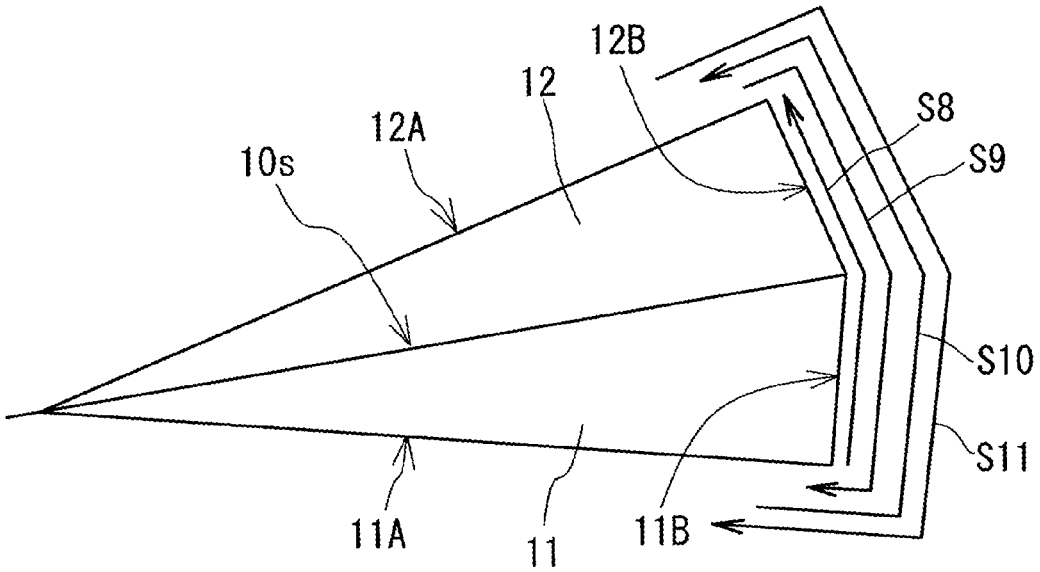

In and after S10, the knitting similar to S9 is repeated. S10 and S11 illustrate three cycles of C-shaped knitting. FIG. 5B shows a schematic knitting image for S9 to S11. In each of the cycles of C-shaped knitting, a third widening stitch 6 and a fourth widening stitch 7 are formed at the positions on the sides of the long edges 11A and 12A so as to increase the knitting width of the C-shaped knitting part 13. The third widening stitches 6 and the fourth widening stitches 7 are provided on the first knitted fabric part 11 side and the second knitted fabric part 12 side of the C-shaped knitting part 13. Accordingly, the widening stitches 6 and 7 are disposed on the sole cover 2 side in FIG. 2, together with the setup portion 10*s* and the knitted fabric parts 11 and 12, and the widening stitches 6 and 7 will not therefore impair the appearance of the instep cover 3.

By repeating the C-shaped knitting illustrated in S9 to S11, the first knitted fabric part 11 and the second knitted fabric part 12 are connected by the C-shaped knitting part 13, sequentially from the one end side of the setup portion 10*s*. This C-shaped knitting is repeated until the stitch rows 10F and 10B of the setup portion 10*s* are removed from the FB and the BB. As a result, the closed end region 10 shown in FIG. 2 is formed.

Thereafter, the remaining part 19 of the shoe 1 is knitted following the termination 10*e* in the wale direction of the closed end region 10. The remaining part 19 is knitted by switching between tubular knitting, C-shaped knitting, and flechage knitting as appropriate.

Other Embodiments

There is no particular limitation with respect to the shapes of the first knitted fabric part 11 and the second knitted fabric part 12 shown in FIGS. 5A and 5B. For example, the first knitted fabric part 11 and the second knitted fabric part 12 may be rectangular, trapezoidal, or ridge-like. The rectangular, trapezoidal, or ridge-like shape may be changed by changing, for example, the knitting width of flechage knitting.

In Embodiment 1, when repeating flechage knitting, the movement of stitches and the formation of the widening stitches 4 and 5 on one end side of the setup portion 10*s* are repeated as shown in FIG. 3. In contrast, the first knitted fabric part 11 and the second knitted fabric part 12 may be formed simply by performing flechage knitting only. In addition, the stitch row 10F and the stitch row 10B of the setup portion 10*s* may be directly connected by C-shaped knitting, without knitting the first knitted fabric part 11 and the second knitted fabric part 12.

In Embodiment 1, only an example in which the knitting width of the C-shaped knitting part 13 is increased as shown in FIG. 4 has been described. In contrast, narrowing may be performed in the course of repeating C-shaped knitting.

A bag-shaped knitted fabric obtained by a knitting method of a bag-shaped knitted fabric according to the present invention is not limited to a shoe. For example, the bag-shaped knitted fabric may be a sock, a glove, or the like, or may be an industrial material such as a seat cover, a sofa cover, or a head cover for a golf club. For any bag-shaped knitted fabric, the setup portion 10*s* may be disposed at a position that is inconspicuous in use.

LIST OF REFERENCE NUMERALS

1 Shoe (bag-shaped knitted fabric)
2 Sole cover
3 Instep cover
4 First widening stitch
5 Second widening stitch
6 Third widening stitch
7 Fourth widening stitch
8, 9 Yarn feeder
10 Closed end region
10*e* Termination
10*s* Setup portion
11 First knitted fabric part
11A Long edge
11B Short edge
12 Second knitted fabric part
12A Long edge
12B Short edge
13 C-shaped knitting part
19 Remaining part

What is claimed is:

1. A knitting method of a bag-shaped knitted fabric for knitting a bag-shaped knitted fabric (1) including a closed end region (10) and a remaining part (19) other than the closed end region (10), using a flat knitting machine including a front needle bed (FB) and a back needle bed (BB), comprising:

a step A of forming a setup portion (10*s*) in which a knitting yarn is alternately held on the front needle bed (FB) and the back needle bed (BB);

a step B of forming the closed end region (10) by repeating, sequentially from one end side in a knitting width direction of the setup portion (10*s*) toward another end side thereof, C-shaped knitting in which the one end side serves as a turn back side such that the setup portion (10*s*) extends in a tube axis direction of the bag-shaped knitted fabric (1); and a step C of knitting the remaining part (19) of the bag-shaped knitted fabric (1), following a termination (10*e*) in a wale direction of the closed end region (10), wherein, in the step B, when repeating the C-shaped knitting, a portion on the front needle bed (FB) side of the setup portion (10*s*) and a portion on the back needle bed (BB) side of the setup portion (10*s*) are connected directly or indirectly, and a knitting width of the C-shaped knitting is changed.

2. The knitting method of a bag-shaped knitted fabric according to claim 1, comprising, before the step B, a step D of forming, by flechage knitting, a first knitted fabric part (11) following a stitch row (10F) of the setup portion (10*s*) that is held on the front needle bed (FB), and forming, by flechage knitting, a second knitted fabric part (12) following a stitch row (10B) of the setup portion (10*s*) that is held on the back needle bed (BB), wherein, in the step B, the first knitted fabric part (11) and the second knitted fabric part (12) are connected by the C-shaped knitting.

3. The knitting method of a bag-shaped knitted fabric according to claim 2, wherein, in the step D, the first knitted fabric part (11) is formed by repeating: flechage knitting; moving a stitch row formed by the flechage knitting to the other end side; and forming a first widening stitch (4) on an empty needle formed by the moving, and the second knitted fabric part (12) is formed by repeating: flechage knitting; moving a stitch row formed by the flechage knitting to the other end side; and forming a second widening stitch (5) on an empty needle formed by the moving, and, in the step B, a knitting range of the C-shaped knitting that is performed first includes all the first widening stitches (4) included in the first knitted fabric part (11) and all the second widening stitches (5) included in the second knitted fabric part (12).

4. A bag-shaped knitted fabric (1) comprising:

a closed end region (10); and a remaining part (19) other than the closed end region (10), wherein the closed end region (10) includes:

a setup portion (10*s*) provided in one region in a circumferential direction of the closed end region (10) and extending in a tube axis direction of the bag-shaped knitted fabric (1); and a C-shaped knitting part (13) for sandwiching the setup portion (10*s*), the C-shaped knitting part (13) is sequentially formed from a front end side of the closed end region (10), the remaining part (19) is formed continuously with a termination (10*e*) in a wale direction of the C-shaped knitting part (13), and a knitting width of the C-shaped knitting part (13) changes in the wale direction of the C-shaped knitting part (13).

* * * * *